US006287434B1

(12) United States Patent
Ackel et al.

(10) Patent No.: US 6,287,434 B1
(45) Date of Patent: Sep. 11, 2001

(54) PLATING CELL APPARATUS FOR X-RAY MASK FABRICATION

(75) Inventors: Robin J. Ackel, Swanton; Douglas E. Benoit; Michael H. Charland, both of Essex Junction; Thomas B. Faure, Milton, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/460,785

(22) Filed: Dec. 14, 1999

Related U.S. Application Data

(62) Division of application No. 09/120,774, filed on Jul. 22, 1998, now Pat. No. 6,039,858.

(51) Int. Cl.[7] ..... C25D 17/04; C25D 17/06

(52) U.S. Cl. ..... 204/297.05; 204/224 R; 204/242; 204/DIG. 7

(58) Field of Search ..... 205/118, 136, 205/122, 123, 96, 97, 125; 204/DIG. 7, 297 R, 242, 224 R, 297.05

(56) References Cited

U.S. PATENT DOCUMENTS

| | | | |
|---|---|---|---|
| 2,675,348 | 4/1954 | Greenspan . | |
| 3,350,287 | 10/1967 | Bedi . | |
| 3,437,578 | 4/1969 | Gibbs et al. . | |
| 3,634,047 | 1/1972 | Faulkner . | |
| 3,901,771 | 8/1975 | Froman et al. . | |
| 5,322,614 | 6/1994 | May et al. . | |
| 5,466,358 | 11/1995 | Kiyomiya et al. . | |
| 5,660,699 | 8/1997 | Saito et al. . | |
| 6,071,388 * | 6/2000 | Uzoh | 204/297 R |

* cited by examiner

*Primary Examiner*—Kathryn Gorgos
*Assistant Examiner*—Wesley A. Nicolas
(74) *Attorney, Agent, or Firm*—DeLio & Peterson, LLC; John J. Tomaszewski; Howard J. Walter, Jr.

(57) ABSTRACT

A method and apparatus are provided for the electroplating on only one side of a substrate immersed in an electroplating bath using a device which holds the substrate to be plated in spaced relation to an inhibitor electrode of the device. To fabricate x-ray masks, a boron doped silicon substrate is secured to a dielectric clamp ring which clamp ring has a through opening which overlies the inhibitor electrode. A cathode structure overlies the clamp ring and the cathode structure, substrate and clamp ring are secured to the device by a pivotable, locking mechanism. A space is formed between the back side of the substrate and the surface of the inhibitor electrode so plating occurs on the surface of the inhibitor electrode. The substrate holding apparatus comprises a plate member to which the inhibitor electrode is secured. The clamp holding the substrate overlies the inhibitor electrode and a cathode structure is secured against the plate member.

8 Claims, 5 Drawing Sheets

PLATING CELL APPARATUS FOR X-RAY MASK FABRICATION

This is a divisional of application(s) Ser. No. 09/120,774 filed on Jul. 22, 1998, now U.S. Pat. No. 6,039,858.

BACKGROUND OF THE INVENTION

1. Field of the Invention

This invention relates to an electroplating apparatus and method for the electrodeposition of a metal onto only one side of a substrate immersed in the electroplating bath and, more particularly, to the fabrication of x-ray masks used in the manufacture of electronic components wherein gold is electroplated onto only the chrome/gold plating base membrane area on a boron doped silicon substrate to form the desired circuit configuration of the mask.

2. Description of the Related Art

The electroplating of metal onto one side of a substrate immersed in the electroplating bath is desired for many plating operations varying from tools to electronic components. For convenience, the following description will be directed to electronic component plating and, in particular, to the fabrication of x-ray masks used in electronic component fabrication.

Polymeric materials, such as photoresists, are widely used in the semiconductor industry to produce masks of all types. In mask making the photoresist is overlaid on a surface in which the desired image is to be formed, exposed to the desired image and developed so that the image formed in the photoresist can be replicated in the underlying surface. To achieve the extremely fine details in the resulting replicated image on the underlying surface, necessary to X-ray masks, the photoresist is exposed by electron beams (E-beams).

The general process used to fabricate such X-ray masks is well known. In general, the process requires a substrate consisting of a typically 2.5 micron thick membrane region etched into a boron doped silicon wafer 100 mm in diameter. The substrate is bonded to a dielectric support ring. This assembly forms a mask blank. Alignment windows can be created in the blank by coating the entire surface of the blank with polyimide and etching the silicon away from the areas where the alignment windows are to be created. Once the alignment windows are formed, the polyimide is removed from the central membrane area but left in the area over the alignment windows. The entire blank surface, including the polyimide layer, is then coated with thin layers of chrome and gold as a plating base for later processing and overcoated with approximately 8000 Angstroms of an E-beam sensitive resist.

The photoresist layer on the blank is then exposed in an E-beam lithography system after which the photoresist is developed to form openings therein. A heavy layer of gold, which serves as an absorber, is then electroplated into the openings formed in the photoresist by the developing step. The photoresist and any exposed chrome and gold plating base layers, not covered by the electroplated gold, are usually now stripped from the blank surface leaving the gold absorber deposits on the silicon and polyimide surfaces. This forms an X-ray mask which may now be used to expose a photoresist layer on a semiconductor wafer.

In the production of such masks, extreme accuracy is required for any errors or distortions appearing in the mask will result in the same errors or distortions being replicated in the final products made using the mask. The present invention sets forth a method and apparatus for creating masks having enhanced accuracy.

One of the most important and difficult problems in x-ray mask fabrication is the elimination of defects. Since these masks must have good x-ray and optical transmission in the clear areas of the mask, many different types of defects will degrade mask performance. The reduction or elimination of any defect and foreign material contributor is critical in producing a perfect mask.

When using a gold plating cell apparatus, the gold plating solution is preferably on both sides of the x-ray membrane substrate. This eliminates any pressure differential between the front and back of the mask which can distort the membrane substrate. It also eliminates distortions caused by clamping the substrate with an O-ring seal that is required to prevent plating solution from contacting the back of the substrate as commonly used in fountain plating systems. Consequently, this insures quality stress-free images with no mask pattern distortion and eliminates membrane breakage.

The front side of the boron doped silicon membrane has a thin chrome/gold plating base that is sputter deposited; this is the side of the mask to be plated with a thick (5000 Å) gold absorber layer. Since the plating solution surrounds the front and backside of the membrane substrate and the backside of the boron doped substrate is somewhat conductive in areas, gold attempts to plate on the back of the mask. Since there is no gold or chrome plating base film on the backside of the mask, the gold tries to plate in some areas and has very poor adhesion to the silicon surface. This results in a gold backside residue which is a foreign material defect contributor since it can be rubbed off easily and can migrate to the front side of the mask.

Bearing in mind the problems and deficiencies of the prior art, it is therefore an object of the present invention to provide an apparatus for electroplating a metal onto only one side of a substrate.

It is another object of the present invention to provide an apparatus for electroplating a metal onto only one side of a substrate in the fabrication of x-ray masks used in the manufacture of electronic components wherein gold is electroplated onto a boron doped silicon substrate.

It is an additional object of the invention to provide a device for holding a substrate in an electroplating cell for plating on only one surface of the substrate in a non-continuous immersion or rack plating system.

A further object of the invention is to provide a method for electrodepositing a metal onto only one side of a substrate and, in particular, to a method for the fabrication of x-ray masks used in the manufacture of electronic components wherein gold is electrodeposited onto a plating base on a boron doped silicon substrate.

It is yet another object of the present invention to provide electroplated articles including semiconductor substrates and x-ray masks made using the apparatus and method of the invention and electronic components made using the mask of the invention.

Still other objects and advantages of the invention will in part be readily apparent from the description.

SUMMARY OF THE INVENTION

The above and other objects and advantages, which will be apparent to one of skill in the art, are achieved in the present invention which is directed to, in a first aspect, a method for the electroplating on one side of a substrate which is immersed in an electroplating bath, the method comprising the steps of:

providing a plating system comprising:

a tank containing an electrolyte;

an anode in the electrolyte;

a cathode device comprising:

a planar dielectric plate;

an inhibitor electrode attached to the inner surface of the plate;

a dielectric clamp ring having a front surface and a back surface and a through opening and on which front surface a substrate is secured, the substrate having a front surface to be plated and a back surface which is secured to the front surface of the clamp and which through opening of the clamp ring is positioned overlying the inhibitor electrode with the clamp having a thickness sufficient to form a space between the back surface of the substrate to be plated and the unattached surface of the inhibitor electrode;

a cathode structure having a through opening and preferably a lip onto which lip the ring and substrate are positioned; and means to force the cathode structure, clamp and secured substrate against the inner surface of the plate;

positioning the clamp through opening and cathode structure through opening over the inhibitor electrode;

forcing and securing the cathode structure, substrate and clamp against the plate;

supplying energy to the plating system to provide a positive charge to the anode and a negative charge to the cathode structure and inhibitor electrode;

plating the substrate; and removing the plated substrate from the cathode device.

The method of the invention for the electroplating of a substrate is preferably to make an x-ray mask used for the fabrication of electronic components. The mask substrate is typically boron doped silicon or is coated with a layer of silicon carbide in which a thin membrane is formed on the silicon or silicon carbide to define the desired circuit pattern thereon. The substrate is typically 4 inches (100 mm) in diameter and about 0.025 inch (0.63 mm) thick. The plating solution is typically gold. The clamping means used to hold the substrate is typically about 5 inches (127 mm) in diameter and about 0.275 inch (7 mm) thick and has a lip and a through opening of less than about 4 inches in diameter so that the substrate is positioned on the lip.

In another aspect of the invention, an apparatus for the electroplating on one side of a substrate immersed in an electroplating bath is provided comprising:

a tank containing an electrolyte;

an anode in the electrolyte;

a cathode device as described above positioned in the electrolyte; and means for supplying a current to the anode and the cathode device to plate onto the substrate.

In a further aspect of the invention, a device is provided for holding a substrate immersed in an electroplating bath which substrate is to be electroplated on one side thereof comprising:

a planar dielectric plate;

an inhibitor electrode attached to the inner surface of the plate;

a dielectric clamp ring having a front surface and a back surface and a through opening and on which front surface a substrate is secured, the substrate having a front surface to be plated and a back surface which is secured to the front surface of the clamp and which through opening of the clamp is positioned overlying the inhibitor electrode with the clamp having a thickness sufficient to form a space between the back surface of the substrate to be plated and the unattached surface of the inhibitor electrode;

a cathode structure having a through opening and preferably a lip onto which lip the ring and substrate are positioned; and means to force and secure the cathode structure, clamp and secured substrate against the inner surface of the plate.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
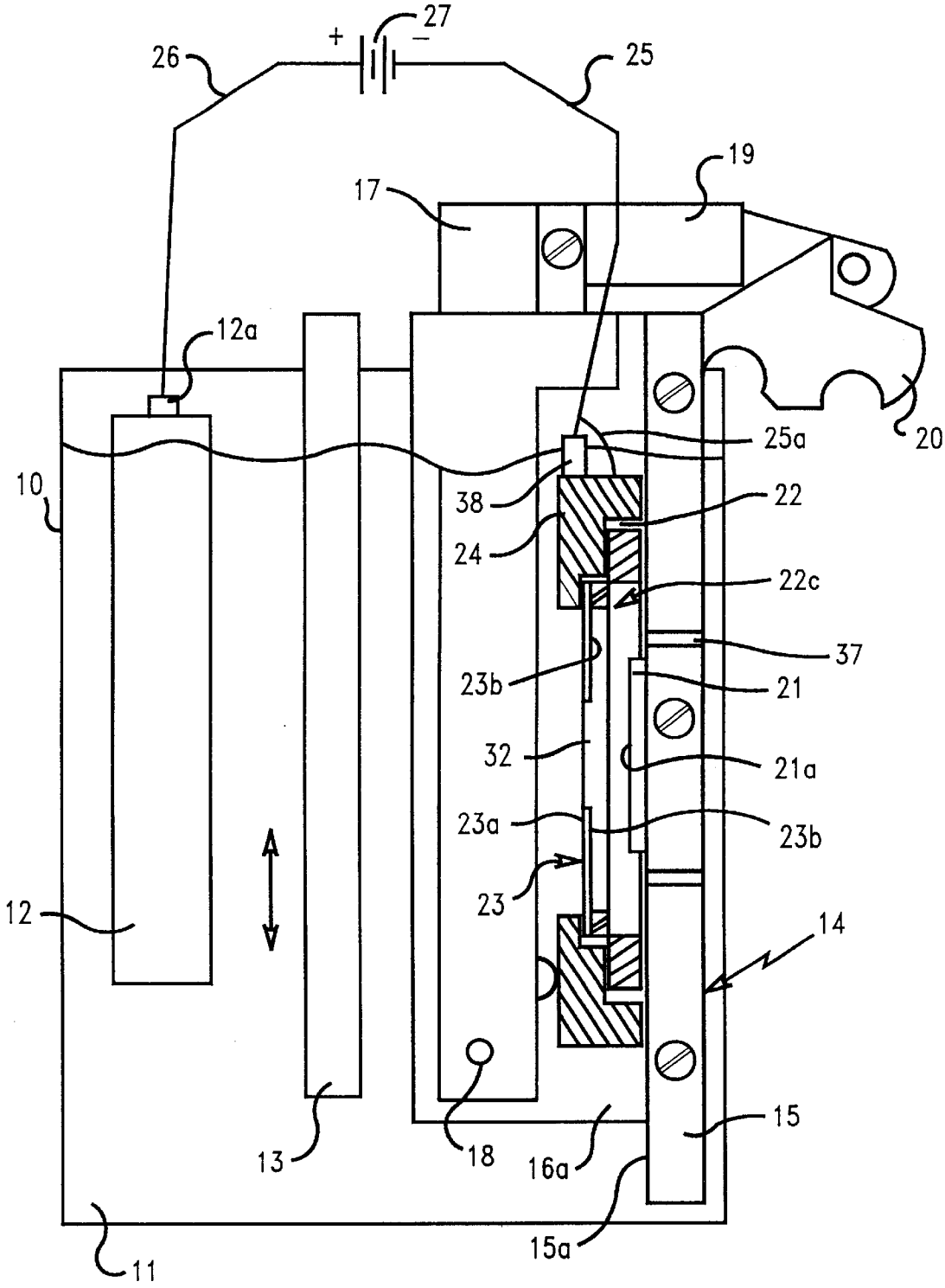
FIG. 1 is a schematic illustration of an electrolytic plating cell using a cathode device of the invention which holds a substrate as a cathode so that only one side of the substrate is plated when the substrate is immersed in the cell and electrolyte contacts both sides of the substrate.

In describing the preferred embodiment of the present invention, reference will be made herein to FIGS. 1–6 of the drawings in which like numerals refer to like features of the invention. Features of the invention are not necessarily shown to scale in the drawings.

Referring to FIG. 1, an electrolytic cell is shown generally as 10 and has an electrolyte 11 therein forming a conductive medium for electrodeposition of a metal typically gold onto a substrate typically a silicon substrate. An anode 12 is disposed in the cell and has an electrical connecting terminal 12*a*. The anode is typically platinum. A mixer 13 is shown in the central part of the cell and the mixer reciprocates up and down to provide a mixing motion in the cell which enhances the plating characteristics of the process.

The cathode device of the invention is shown generally as 14. The device 14 comprises a preferably planar plate member 15 usually rectangular and two connected opposed sidewall members 16*a* and 16*b* (16*b* not shown). The cathode device is in a form of a channel having opposed sidewall members. A locking member 17 pivots around pin 18 and has a clamping latch 19 at the top part of the member. The clamping latch in the closed (locked) position of locking member 17 engages catch 20 positioned at the upper end of plate member 15. As will be more fully discussed hereinbelow, cathode device 14 is used to lock together in electrical connection in the cathode device 14 a substrate to be plated (secured to a clamping ring), a cathode structure supporting the ring and substrate and an inhibitor electrode to inhibit plating on the backside of the substrate. The locked cathode device 14 is then immersed in the electrolyte 11 in the cell 10 for plating on the substrate as a cathode.

A plating inhibitor electrode 21, preferably platinum, is disposed typically centrally on the inner surface 15*a* of plate member 15. The electrode 21 is electrically connected to power source 27 through circuit lines 25*a* and 25 and has the same potential as substrate 23. Shown in the figure is a substrate 23 secured to clamp ring 22. A central through opening 22*c* of the clamp overlies platinum electrode 21. Thus, the top exposed surface 21*a* of platinum electrode 21 is facing the bottom surface 23*b* of substrate 23. A cathode structure 24 is shown positioned over substrate 23 and clamp ring 22. The cathode structure 24 has a central opening which exposes upper surface 23*a* of substrate 23 to the electrolyte. The cathode structure 24 has a terminal 38 for connection to a power source through line 25. As will be more fully discussed hereinbelow, when a current is applied to the electrolytic cell from power source 27, the substrate 23 acts as a cathode since it is in electrical contact with cathode structure 24. Platinum inhibitor electrode 21 is also connected to the negative terminal through circuit lines 25 and 25*a* of the power source 27 and also acts as a cathode. The platinum inhibitor electrode 21 connected as a cathode acts as a scavenger and metal is preferentially plated on the surface 21*a* of inhibitor cathode 21 instead of on the backside 23*b* of substrate 23 because the surface of the inhibitor cathode is at a more negative potential than the backside surface of the substrate. This is an important feature of the invention and prevents unwanted plating of the backside of the substrate. Metal is plated onto the exposed front surface 23*a* of substrate 23 when an electrolytic current is generated in the cell. Through openings 37 in plate 15 allow electrolyte to flow around and between inhibitor electrode 21 and the backside 23*b* of substrate 23.

Figure 2:
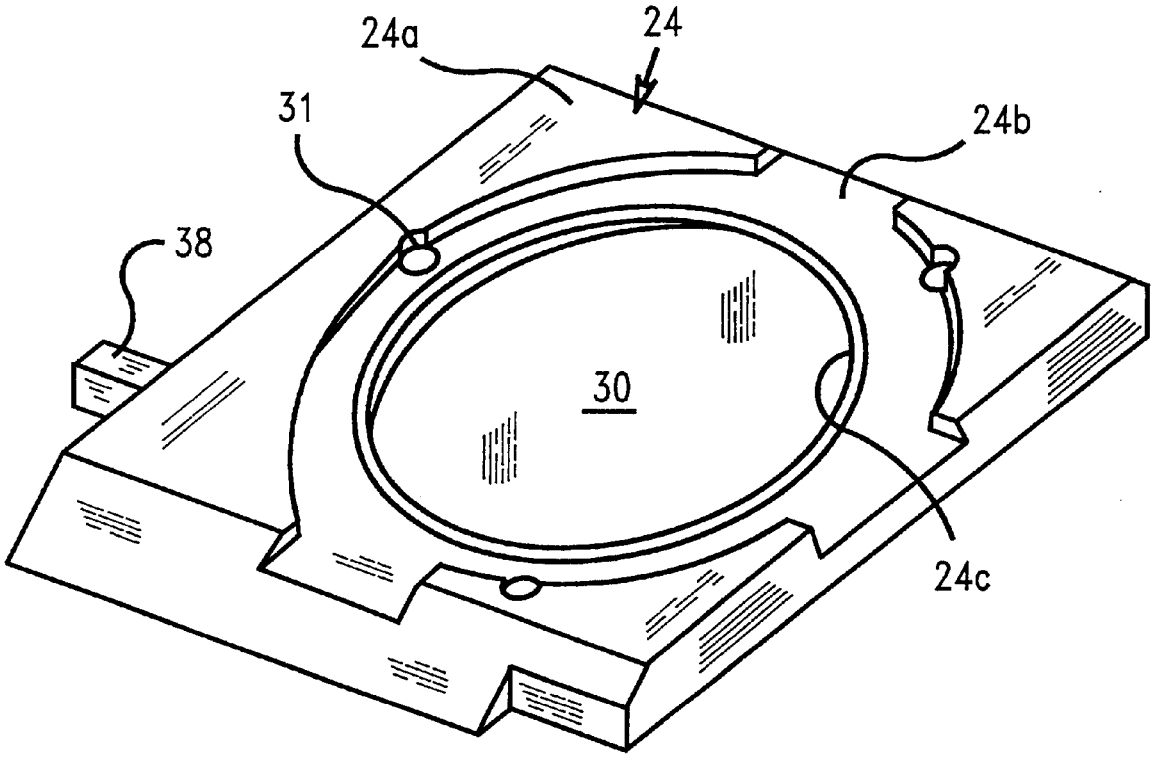
FIG. 2 is a perspective view of a cathode structure used in the cathode device of the invention.

Referring to FIG. 2, a cathode structure 24 used with the cathode device 14 is shown. The cathode structure 24 is generally planar and rectangular and has a terminal 38 for connection to a power source. The cathode structure has an upper surface 24*a*, a first lip 24*b* and a second lip 24*c*. The substrate to be plated rests on second lip 24*c* and the clamping ring to which the substrate is secured rests on lip 24*b*. The cathode structure 24 has a through opening 30 which is sized to expose the substrate to be plated. The cathode structure 24 can be made of any suitable conductive material and is preferably gold plated brass. Notches 31 are provided for positioning the cathode structure against the plate 15 of cathode device 14 as shown in FIG. 1.

Figure 3:
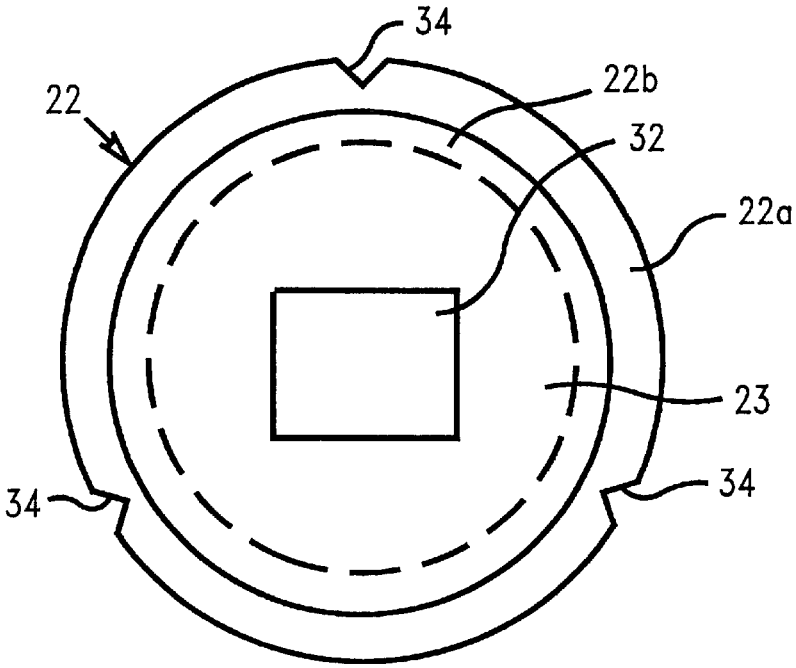
FIG. 3 is a top plan view of a silicon substrate to be plated secured to a clamping support ring.
Figure 4:
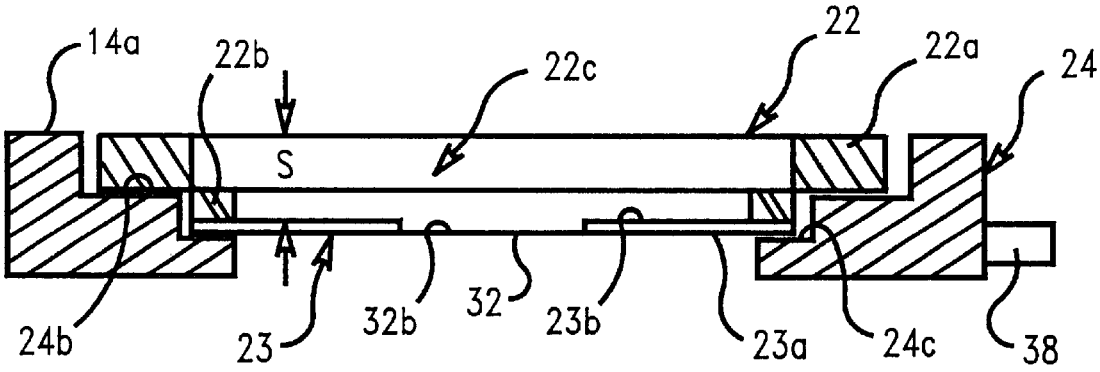
FIG. 4 is a side elevational view of FIG. 3 showing a substrate secured to a clamping support ring and which ring is positioned in a cathode structure used in the cathode device of the invention.

Referring to FIGS. 3 and 4, a circular substrate 23 to be plated is shown secured to lip 22*b* of clamp ring 22. The clamp ring 22 has an upper surface 22*a* and an inner lip 22*b* and is typically made of Pyrex®. The clamp has a plurality of spaced notches 34 therein which correspond to notches 31 of cathode structure 24 as shown in FIG. 2 for locating and positioning the clamp in the cathode structure 24 which structure is then positioned in the cathode device 14 of the invention. The substrate 23 has a central square membrane area 32 on which it is desired to plate the circuit design of the x-ray mask as discussed hereinbelow. As can be seen from FIG. 4, clamp ring 22 has an upper portion 22*a* and an inner lip 22*b* and a central through opening 22*c*. The substrate 23 is secured to the lower surface of lip 22*b*. The space S between the lower surface 23*b* of substrate 23 and the lower surface of ring portion 22*a* overlies inhibitor electrode 21 and is filled with electrolyte and provides for preferential plating of surface 21*a* of the inhibitor electrode 21 instead of the lower surface 23*b* or membrane 32*b* of substrate 23 during the plating process.

Figure 5:
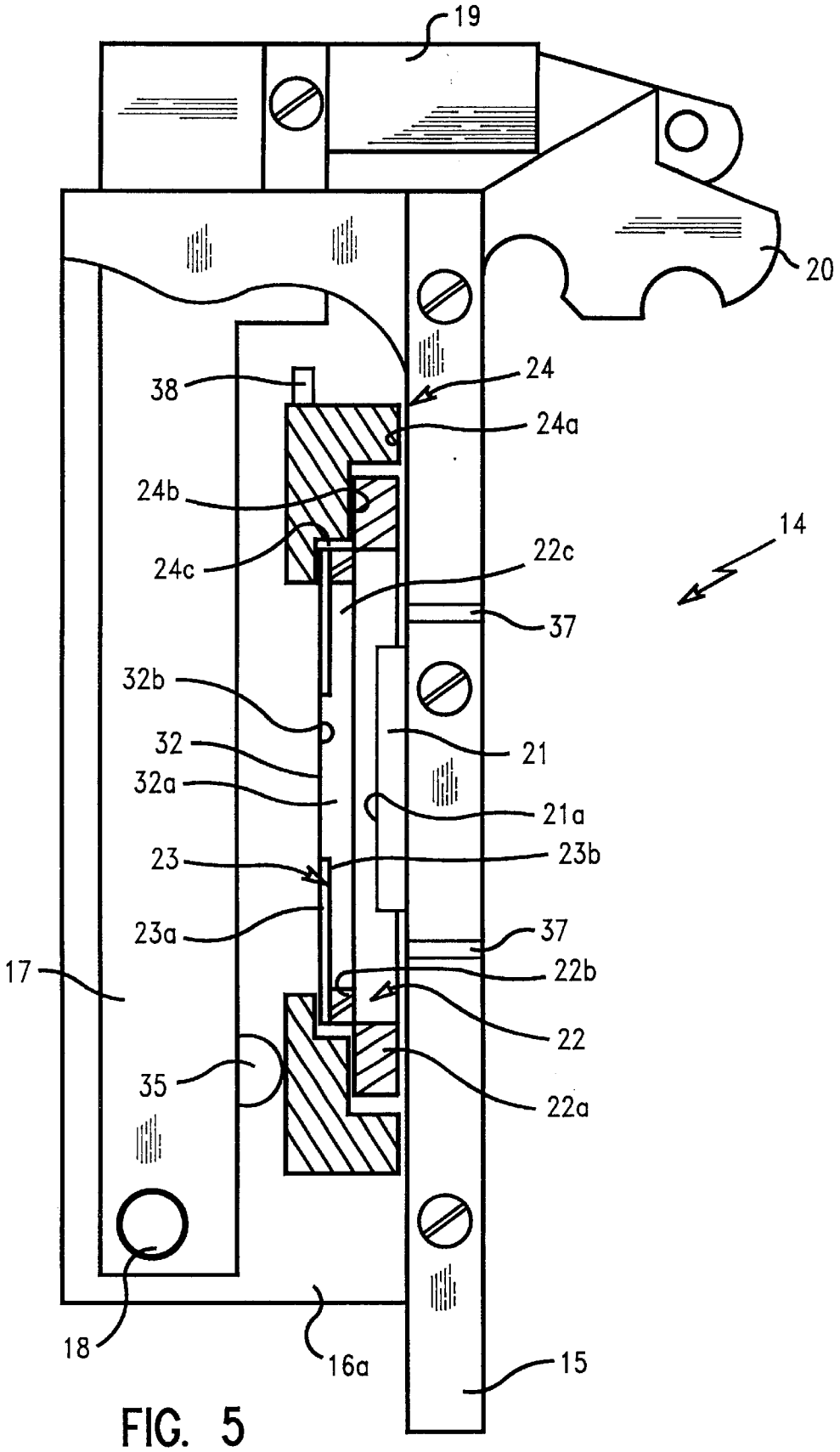
FIG. 5 is a side elevational partial cut-away view of a cathode device of the invention holding a silicon substrate to be plated.

Referring to FIG. 5, the cathode device 14 of the invention is shown. The figure is a partial cut-away side view of the cathode device and comprises a planar plate member 15. Attached to the member plate 15 are opposed side wall members 16*a* and 16*b* (16*b* not shown). Locking member 17 is shown pivotable around pin 18 and at the upper end thereof is a latch 19 which is shown secured in catch 20 of the cathode device 14. The plate 15, wall members 16*a* and 16*b* and locking member 17 are preferably made of a dielectric such as plastic such as Plexiglas® and Lexan®. The locking member 17 has a resilient knob 35 on the inner surface thereof to urge against the surface of cathode structure 24 in the locked position locking the cathode structure 24 and nested substrate 23 and clamping ring 22 in the cathode device. The clamping ring 22 is sized to rest against inner surface 15*a* in the locked position and for the through opening 22*c* therein to overlie inhibitor electrode 21.

Referring again to FIGS. 4 and 5, the assembly of the substrate clamp and the cathode structure in the cathode device may be demonstrated. Thus, the ring or clamp 22 holding substrate 23 is disposed against the inner surface 15*a* of plate member 15. The through opening 22*c* in ring 22 exposes the substrate backside 23*b* and membrane surface 32*b* to the upper surface 21*a* of platinum electrode 21. The ring 22 is positioned in the cathode structure 24 by locator pins 31*a* (not shown) meshing with notches 34 in the ring 22 and notches 31 in the cathode structure 24. When the substrate 23 and clamp ring 22 are in position in cathode structure 24, the cathode structure 24 is positioned over inhibitor electrode 21. The surface 22*a* of the clamp ring 22 and surface 24*a* of cathode structure 24 rests against the inner side 15*a* of the plate 15. The assembly is then locked in place by rotating locking member 17 about pin 18 so that resilient member 35 urges against cathode structure 24. Locking member 17 is locked in place by latch 19 engaging catch 20. The cathode device assembly may then be placed in electrolytic cell 10 for electroplating of the upper surface 32*a* of the substrate. Openings 37 in plate member 15 allow electrolyte to flow in and out of the spaces between the substrate and inhibitor electrode 21.

Figure 6:
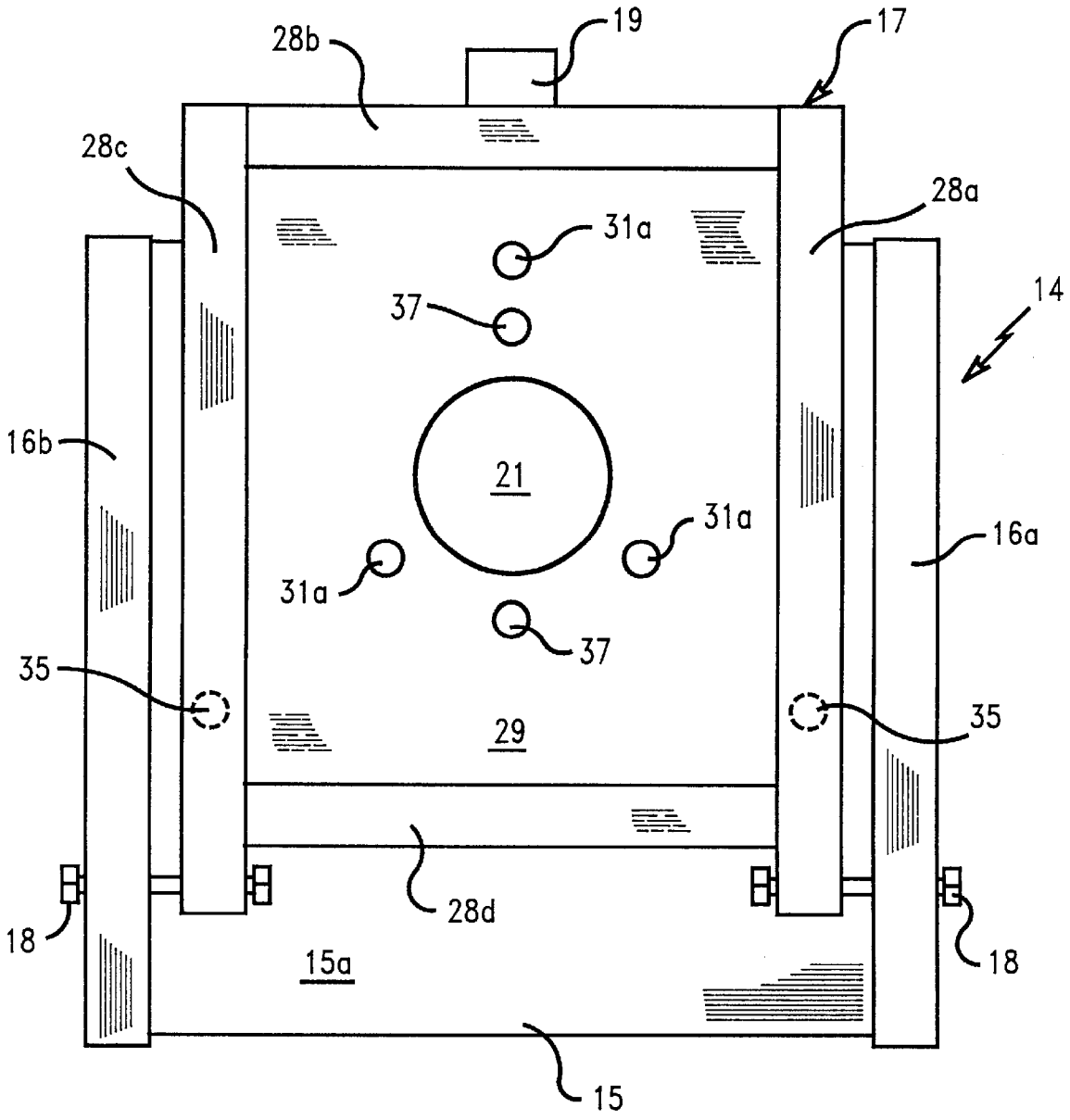
FIG. 6 is a front elevational view of the cathode device of the invention shown in FIG. 5 without the cathode structure, clamp ring and substrate to be plated.

Referring to FIG. 6, a front view of a preferred cathode device 14 is shown. Plate member 15 has attached thereto at each side opposed sidewall members 16*a* and 16*b* forming a channel bounded by the sidewalls 16*a* and 16*b*. A locking device shown generally as 17 comprises connected elongated members 28*a*, 28*b*, 28*c* and 28*d* forming a rectangular structure open between the sidewall thereof shown as 29. Members 28*a* and 28*c* of locking member 17 are secured to sidewalls 16*a* and 16*b* respectively by pins 18. Locking member 17 is then able to rotate about pins 18. Latch 19 on locking member 17 in the locked position holds the cathode structure, substrate and clamp in the cathode device 14 against the inner surface 15*a* of back plate 15. On the inner surface 15*a* of plate member 15 is shown a platinum electrode 21 in circular form. Referring back to FIG. 5, locking member 17 would be unlocked and pulled forward away from plate member 15. The clamp ring 22 holding substrate 23 would then be positioned in cathode structure 24 and the assembly of the clamp, substrate and cathode structure positioned against wall 15*a*. Locking member 17 is then swung upward and locked into position by latch 19. In this position, the resilient member 35 of locking member 17 is urged against the cathode structure 24 surface locking the cathode structure, substrate and clamp in position in the cathode device 14. Through openings 37 in plate 15 allow electrolyte to flow into the cathode device contacting inhibitor electrode 21 and substrate 23. Locator pins 31*a* are used to position the cathode structure against the inner surface 15*a* of plate 15. The cathode device 14 in the locked position would then be inserted into the cell for electrodeposition.

While plating is only generally desired on the membrane surface 32*a,* it can be seen that the substrate surface 23*a* as well as the face of the cathode structure 24 is exposed to the electrolyte and plating will result on both surfaces since both areas are exposed to the electrolyte. For some processes, the face of the cathode structure may be masked so that plating only occurs on the unmasked areas of the cathode structure and on the substrate to be plated. Commercially acceptable X-ray masks were made using the method and apparatus of this invention.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for the electroplating on one side of a substrate immersed in an electroplating bath comprising:

a tank containing an electrolyte;

an anode in the electrolyte;

a cathode device comprising:

a planar dielectric plate having an inner surface and outer surface;

an inhibitor electrode attached to the inner surface of the plate;

a dielectric clamp ring having a front surface and a back surface and a through opening and on which front surface a substrate is secured, the substrate having a front surface to be plated and a back surface which is secured to the front surface of the clamp ring and which through opening of the clamp ring is positioned overlying the inhibitor electrode with the clamp ring having a thickness sufficient to form a space between the back surface of the substrate to be plated and the unattached surface of the inhibitor electrode;

a cathode structure having a through opening and a lip onto which lip the clamp ring and substrate are positioned; and means to force the cathode structure, clamp ring and secured substrate against the inner surface of the plate; and means for supplying a current to the anode and the cathode device to plate the substrate.

2. The apparatus of claim 1 wherein the substrate is a silicon substrate.

3. The apparatus of claim 2 wherein the silicon substrate is used to make an x-ray mask.

4. The apparatus of claim 1 wherein the substrate has a central membrane area onto which a metal is electroplated.

5. The apparatus of claim 4 wherein the metal electroplated is gold.

6. A device is provided for holding a substrate immersed in an electroplating bath to be electroplated on one side thereof comprising:

a planar dielectric plate having an inner surface and an outer surface;

an inhibitor electrode attached to the inner surface of the plate;

a dielectric clamp ring having a front surface and a back surface and a through opening and on which first surface a substrate is secured, the substrate having a front surface to be plated and a back surface which is secured to the front surface of the clamp ring and which through opening of the clamp ring is positioned overlying the inhibitor electrode with the clamp ring having a thickness sufficient to form a space between the back surface of the substrate to be plated and the unattached surface of the inhibitor electrode;

a cathode structure having a through opening and in which the clamp ring and substrate are positioned; and means to force the cathode structure, clamp ring and secured substrate against the inner surface of the plate.

7. The device of claim 6 wherein the dielectric plate and forcing means are plastic.

8. The device of claim 7 wherein the inhibitor electrode is platinum.

* * * * *